US006474388B2

(12) United States Patent
Boss

(10) Patent No.: US 6,474,388 B2
(45) **Date of Patent: *Nov. 5, 2002**

(54) APPARATUS FOR BINDING SHEET MEDIA

(75) Inventor: Roland Boss, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/816,817

(22) Filed: Mar. 22, 2001

(65) Prior Publication Data

US 2001/0019691 A1 Sep. 6, 2001

Related U.S. Application Data

(63) Continuation-in-part of application No. 09/482,124, filed on Jan. 11, 2000.

(51) Int. Cl.[7] ..... G05F 3/02

(52) U.S. Cl. ..... 156/367; 156/583.1; 412/33; 412/902

(58) Field of Search ..... 156/580, 583, 156/91, 498, 367, 277, 290–291, 384–385, 386, 311, 908, 228, 282, 324; 412/8, 33, 900, 902, 22

(56) References Cited

U.S. PATENT DOCUMENTS 3,607,545 A * 9/1971 Parsons et al. ..... 156/311
3,793,016 A * 2/1974 Eichorn ..... 118/638
3,943,024 A * 3/1976 Sendor et al. ..... 156/358
4,311,549 A * 1/1982 Vercillo ..... 100/137
4,398,986 A * 8/1983 Smith et al. ..... 156/290
4,454,704 A * 6/1984 Ullman ..... 156/359
5,213,560 A 5/1993 Crowley ..... 493/231
5,328,438 A 7/1994 Crowley ..... 493/187
5,456,646 A 10/1995 Crowley ..... 493/187
5,582,570 A 12/1996 Crowley ..... 493/197
6,257,293 B1 * 7/2001 Face et al. ..... 156/351

* cited by examiner

*Primary Examiner*—Michael W. Bail
*Assistant Examiner*—Jessica Rossi

(57) ABSTRACT

A device for binding a stack of media sheets using imaging material as the binding agent. The binding device includes a tray for supporting the stack and a heated platen or some other type of imaging material activator near the tray. A press coupled to the activator is operative between a first position in which the activator is separated from the stack to a second position in which the activator contacts and compresses the stack at the binding region. A spring or other biasing mechanism operatively connected between the press and the activator biases the activator against the stack when the press is in the second position. The biasing mechanism allows pressure to be maintained on the stack to reactivate the imaging material without continuing to power the press down against the stack even as the stack shrinks under the reactivating pressure. Hence, power can be diverted if necessary or desirable from the press to activator to reduce the overall power consumption of the binding device.

2 Claims, 13 Drawing Sheets

APPARATUS FOR BINDING SHEET MEDIA

CROSS REFERENCE TO RELATE APPLICATION

This is a continuation-in-part of Application Ser. No. 09/482,124 filed Jan. 11, 2000.

FIELD OF THE INVENTION

This invention relates to an apparatus and method for binding media sheets. More particularly, the invention relates to an apparatus and method for producing a bound document from a plurality of media sheets using imaging material as a binding agent.

BACKGROUND

Current devices and methods for printing and binding media sheets involve printing the desired document on a plurality of media sheets, assembling the media sheets into a stack, and separately stapling, clamping, gluing and/or sewing the stack. In addition to imaging material used to print the document, each of these binding methods require separate binding materials, increasing the cost and complexity of binding. Techniques for binding media sheets using a common printing and binding material are known in the art. These techniques generally involve applying imaging material such as toner to defined binding regions on multiple sheets, assembling the media sheets into a stack, and reactivating the imaging material, causing the media sheets to adhere to one another.

These known devices and methods, however, can consume significantly more time than producing an unbound document. Each involves printing the entire or a substantial portion of the desired document, then assembling and aligning the media sheets into a stack in preparation to be bound. Binding the stack of media sheets also entails applying sufficient heat to the binding region to reactivate the imaging material throughout multiple sheets or throughout the entire stack. Consequently, the thickness of the bound document is limited by the device's ability to adequately heat the binding regions throughout multiple sheets or the stack without damaging the media sheets. In some instance it is desirable to simultaneously bind a stack of media sheets. However, as the binding regions of the sheets in the stack are heated, the thickness of the stack decreases. Failing to compensate for this decrease produces sub-optimal binding conditions.

SUMMARY

The present invention is directed to a device for binding a stack of media sheets using imaging material as the binding agent. In one embodiment, the binding device includes a tray for supporting the stack and a heated platen or some other type of imaging material activator near the tray. A press coupled to the activator is operative between a first position in which the activator is separated from the stack to a second position in which the activator contacts and compresses the stack at the binding region. A spring or other biasing mechanism operatively connected between the press and the activator biases the activator against the stack when the press is in the second position. The biasing mechanism allows pressure to be maintained on the stack to reactivate the imaging material without continuing to power the press down against the stack even as the stack shrinks under the reactivating pressure. Hence, power can be diverted if necessary or desirable from the press to activator to reduce the overall power consumption of the binding device.

DETAILED DESCRIPTION OF THE INVENTION

Figure 1:
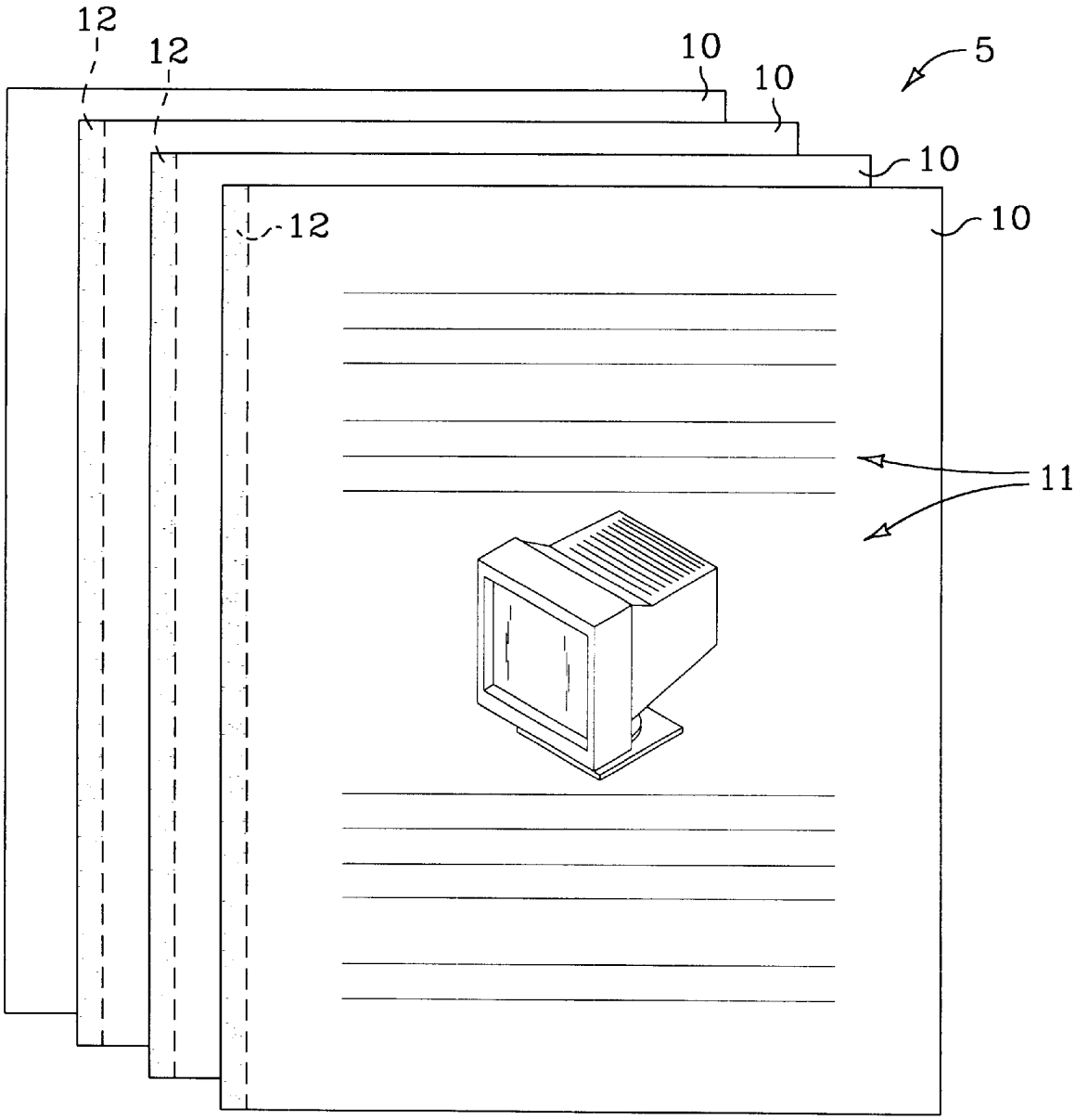
FIG. 1 is a plan view of multiple media sheets that will be bound in to a document showing the toner binding region along the left edge of each sheet.

FIG. 1 shows multiple media sheets used to form a document 5, each media sheet generally referenced as 10. Document 5 includes multiple print images 11. Each print image 11 represents a page of document 5 and may include text and/or graphics. Each media sheet 10 may have a print image 11 applied to one or both sides. For example, a ten page document, composed of ten print images, may be produced on five media sheets, one print image on each side. Each media sheet 10 also includes imaging material, such as toner, applied to one or more selected binding regions 12. Binding region 12 usually will be located along one edge of media sheet 10 on one or both sides. Preferably, binding region 12 is applied to only the bottom side of each sheet in which case it is not necessary to apply imaging material to a binding region on the first/bottom sheet. The dotted lines along binding regions 12 in the Figures indicate the imaging material has been applied to the bottom side of the sheet.

My earlier filed patent application, Ser. No. 09/482,124 (the '124 application), discloses a new method and apparatus for binding documents by individually binding each media sheet to previously bound media sheets using imaging material as the binding material. The binding devices described in the '124 application may be adapted for use with the present invention in which stacked sheets are simultaneously bound together using imaging material as the binding agent. The binding devices 22 in FIGS. 2 and 3A–3C and FIGS. 4A–4C, for example, are similar to the binding devices described in the '124 application.

Figure 2:
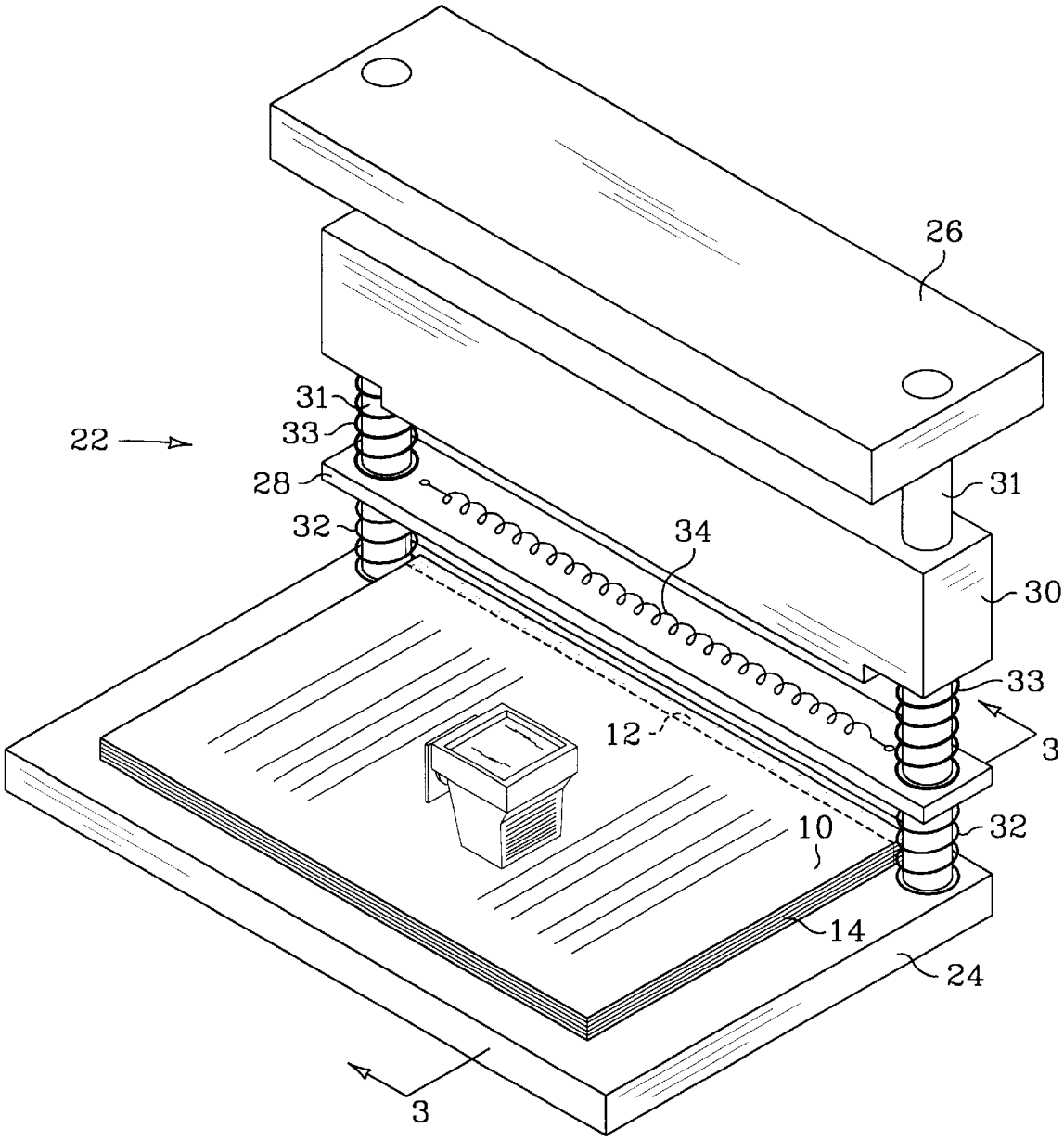
FIG. 2 is a perspective view of a binding device constructed according to one embodiment of the invention in which the document is stacked horizontally and the binder uses a thermally dissipative heat sink.

Referring now to FIG. 2, document 5 is formed by binding a stack 14 of sheets 10. Stack 14 represents generally an entire document or only part of a document. The binding region 12 on each sheet is aligned with the binding region of the sheets in stack 14 and the imaging material applied to binding region 12 is reactivated to fuse and thereby bind stacked sheets 10. The strength of the inter-sheet bond is a function of the type, area, density, and degree of reactivation of the imaging material applied to binding region 12 of each media sheet 10. By varying these parameters the inter-sheet bond can be made very strong to firmly bind the document or less strong to allow easy separation. It is expected that the imaging material will usually be reactivated by applying heat and pressure. A variety of other reactivation techniques that may be used are described in my copending application Ser. No. 09/320,060, titled Binding Sheet Media Using Imaging Material, which is incorporated herein by reference in its entirety.

Binding apparatus 22 includes a sheet collecting tray 24, press 26, heated platen 28 and an optional heat sink 30. Press 26, heated platen 28 and heat sink 30 move up and down or back and forth along guide posts 31. Heated platen 28 is biased away from the sheet collection area of tray 24 with, for example, compression springs 32 to provide adequate clearance for the document. Press 26 is operatively coupled to heated platen 28 through heat sink 30 and a second pair of compression springs 33 positioned between heat sink 30 and heated platen 28. Preferably, heat sink 30 will have a much greater effective thermal mass than heated platen 28 and heated platen 28 will be very thin to promote rapid heating and cooling. In this embodiment, heated platen 28 includes an electrically resistive heating element 34. Heated platen 28 is heated, for example, by electric current passing through a resistive element 34. The relatively large thermal mass of heat sink 30 may be achieved in a variety of ways. For example, heat may be dissipated passively through a large physical mass of thermally conductive material that dissipates heat by thermal conduction as it contacts heated platen 28. Heat may be dissipated actively through a convection heat sink in which moving air is used to cool heated platen 28. Or, heat may be dissipated through a material having a much lower electrical resistance that diverts electrical current from heated platen 28. A combination of two more of these techniques might also be used. The relation of the heat capacities of heated platen 28 and heat sink 30 can be optimized for the particular operating environment to help facilitate continuous operation of binder 22.

Figure 3A:
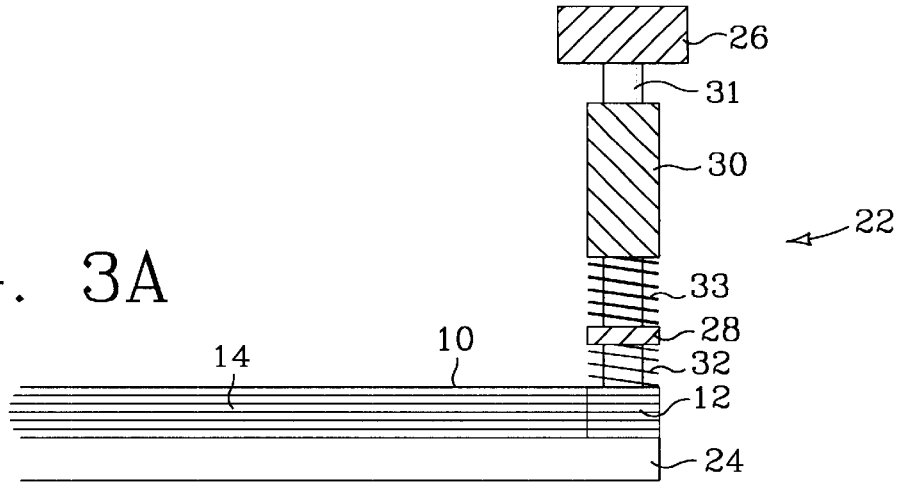
FIGS. 3A–3E are sequential cross section views illustrating the operation of the binding device of FIG. 2.
Figure 3B:
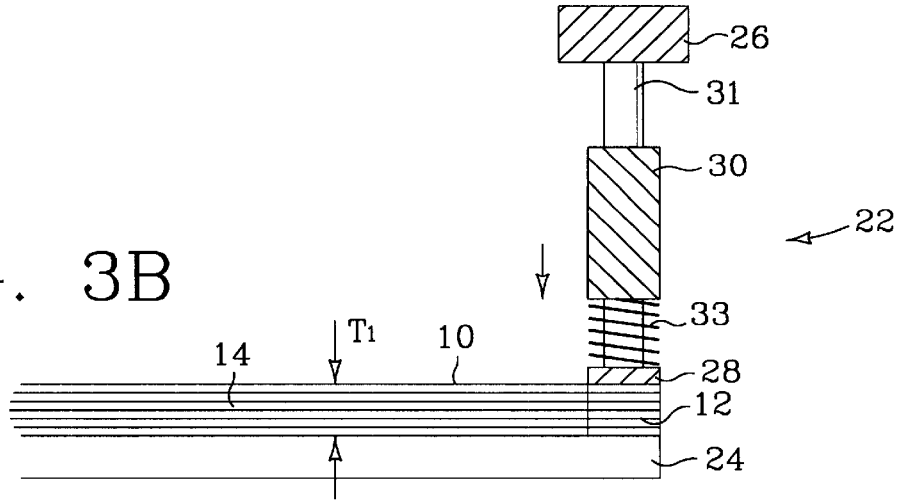
Figure 3C:
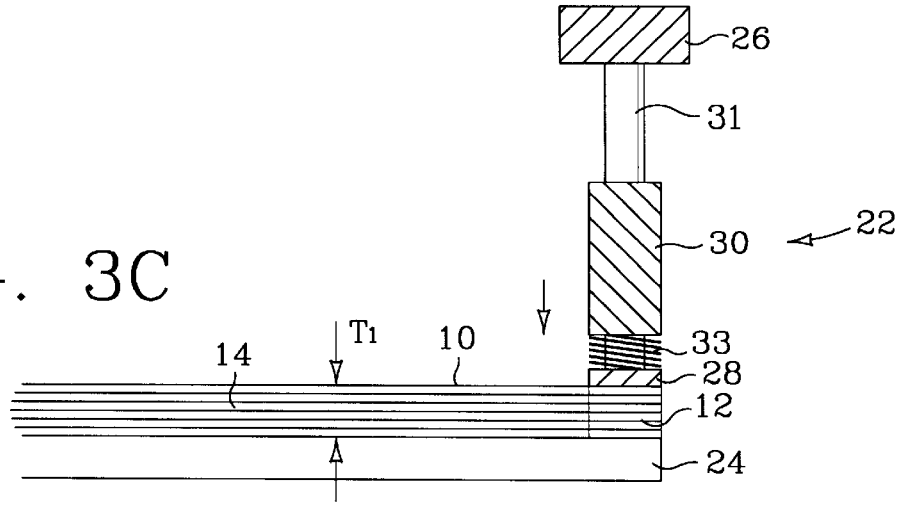

The operation of binder 22 will now be described with reference to the section view of binder 22 in FIGS. 3A–3C. Each sheet 10 is output from the printer, copier, fax machine or other image forming device into tray 24. Sheet 10 is aligned to the stack 14 as may be necessary or desirable using conventional techniques. Once the desired number of sheets, one full document for example, are output to tray 24, press 26 descends against heat sink 30, overcomes the resistance of first biasing springs 32 and presses heated platen 28 against stack 14 along binding region 12, as seen by comparing FIGS. 3A and 3B. The heat and pressure applied to binding region 12 of sheet 10 reactivates the imaging material (melts the toner) in region 12.

Often, the power available to compress and heat binding regions 12 of stack 14 is limited. Once binding regions are compressed it is desirable to divert power from press 26 and utilize the available power for reactivating the imaging material. As imaging material such as toner is reactivated, it melts and spreads slightly causing the thickness of stack 14 to decrease. To create a secure and consistent bond, it is helpful to maintain pressure on binding regions 12 of each sheet 10 in stack 14 as the applied imaging material is reactivated and cooled without driving press 26 further down on the stack. Hence, press 26 continues to descend to overcome the resistance of second biasing springs 33 to the position shown in FIG. 3C. The thickness of stack 14 at this point is represented by T1 in FIGS. 3B and 3C. As heated platen 28 re-activates and melts the imaging material on binding regions 12 and the thickness of stack 14 decreases to T2, second biasing springs 33 expand to maintain pressure on heated platen 28 without driving press 26 further down on the stack, as seen by comparing FIGS. 3C and 3D. The compressed thickness of stack 14 is represented by T2 in FIG. 3D.

Figure 3D:
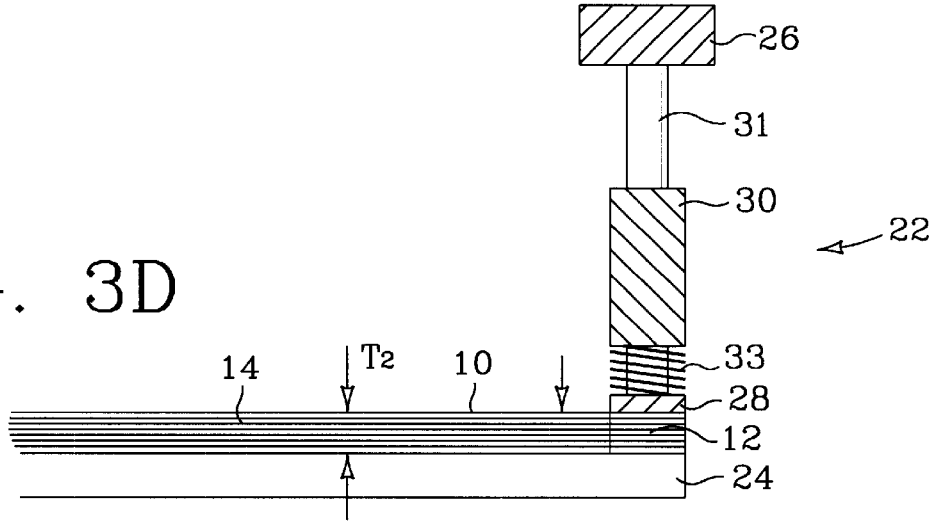
Figure 3E:
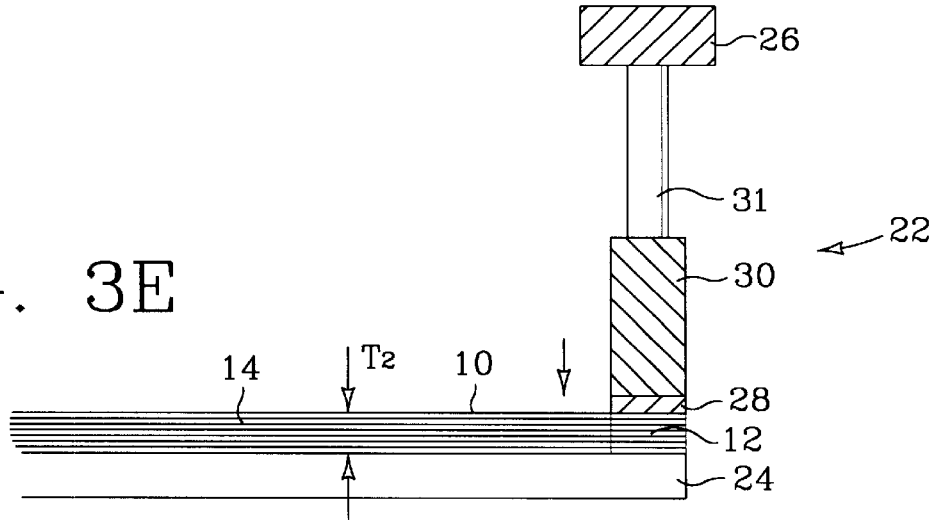
Figure 4A:
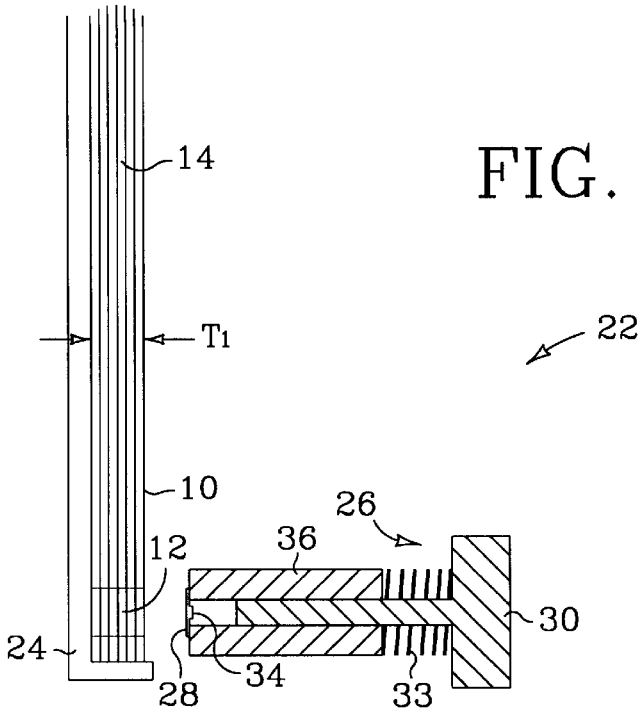
FIGS. 4A–4E are sequential cross section views illustrating the operation of a binding device constructed according to a second embodiment of the invention in which the document is stacked vertically and the binder uses an electrically dissipative heat sink.
Figure 4B:
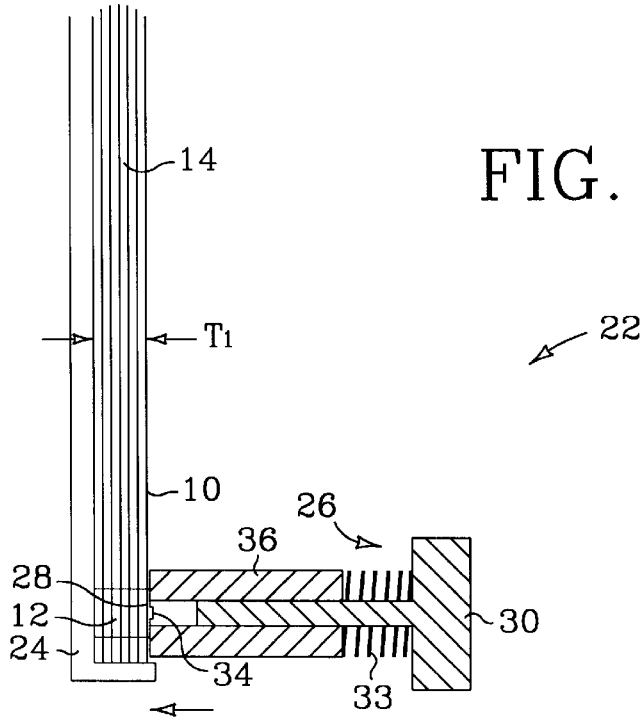
Figure 4C:
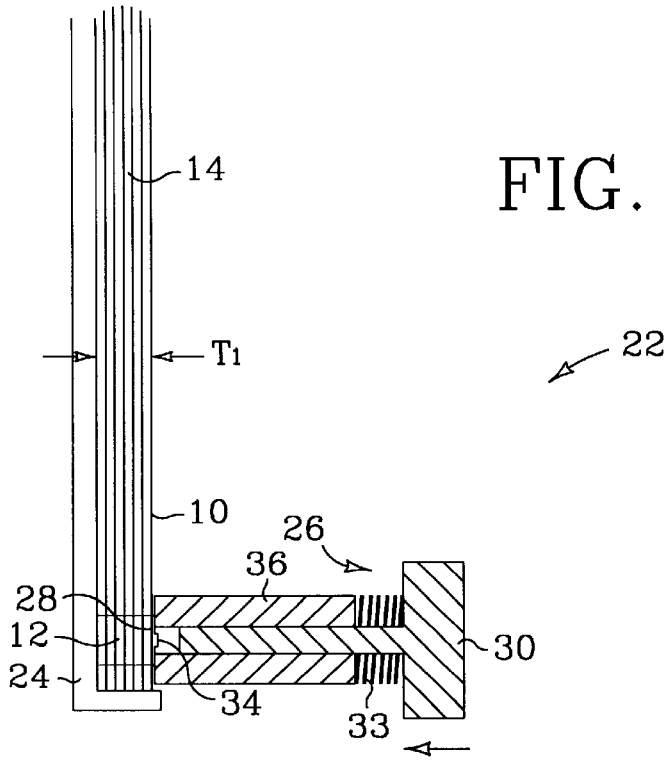
Figure 4D:
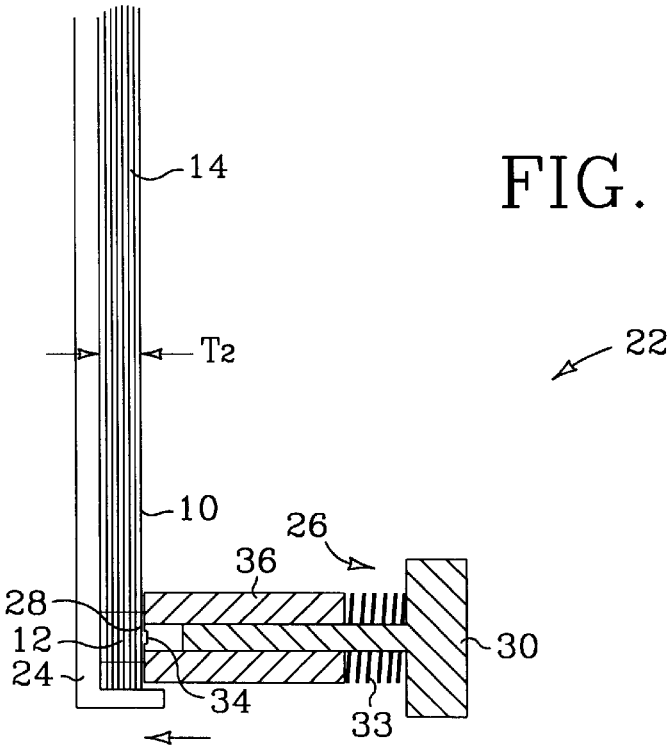
Figure 4E:
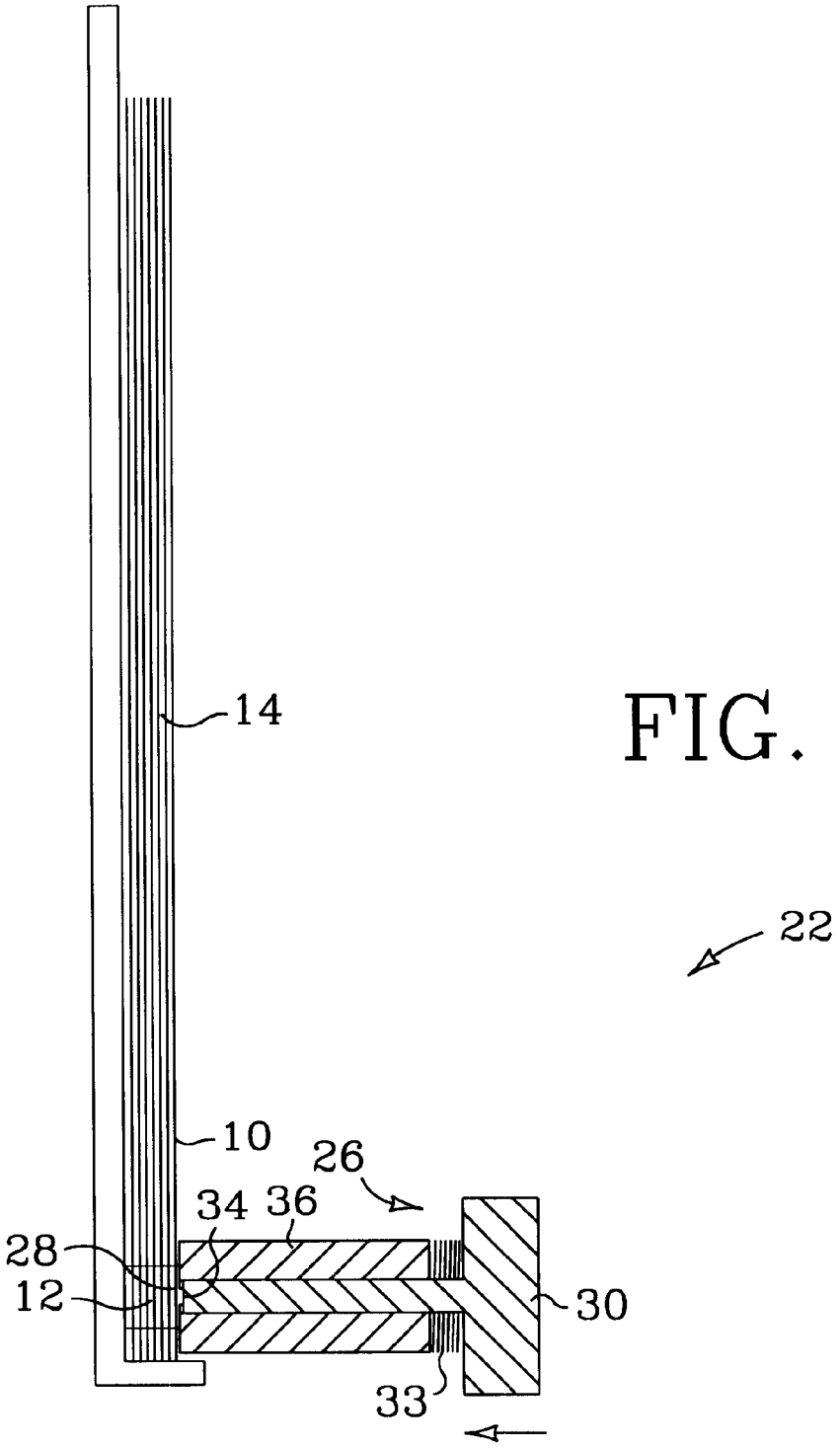

If optional heat sink 30 is used, once the imaging material is melted, press 26 is re-energized to press heat sink 30 into contact with heated platen 28, as seen by comparing FIGS. 3D and 3E. The large comparatively cool thermal mass of heat sink 30 cools heated platen 28, sheet 10 and stack 14. Press 26 is held momentarily in the fully descended position to maintain pressure on sheet 10 and stack 14 as the heated platen 28 cools. The cooling combined with the continuing compression of media sheet 10 and stack 14 allows the reactivated imaging material (melted toner) to cure. As the pressure is released, biasing springs 32 and 33 return heated platen 28 and heat sink 30 to their respective starting positions.

In the embodiment illustrated in FIGS. 2 and 3A–3E, heat sink 30 is a highly thermally conductive material such as an aluminum block or a forced air convection type heat exchanger. Heat sink 30 must be large enough to dissipate heat from heated platen 28 throughout the binding operation. The size and thermal conductivity of heat sink 30 will depend on a variety of operating parameters for the particular printing system, including the speed of the printer (usually measured in pages output per minute), the maximum number of pages in the bound document, the characteristics of the toner or other imaging materials used to bind the pages and the availability of cooling air flow. Second springs 33 are stiffer than first springs 32 so that as press 26 descends heated platen 28 is pressed against the stack 14 before heat sink 30 is pressed against heated platen 28.

FIGS. 4A–4E illustrate an alternative embodiment in which the press 26 moves horizontally and an electrically dissipative heat sink 30 is used instead of the thermally dissipative heat sink of FIG. 2. Referring to FIGS. 4A–4E, sheets 10 accumulate in a vertically oriented tray 26. As heat sink 30 is pressed toward tray 24, heated platen 28 is pressed into stack 14 at the urging of springs 33 and slide block 36. As with the first embodiment, the heat and pressure applied to binding region 12 of sheet 10 reactivates the imaging material in region 12. As heat sink 30 is pressed further towards tray 24, it overcomes the resistance of springs 33 and electrically contacts resistive element 34. This electrical contact diverts or "short circuits" the electrical current from resistive heating element 34 in heated platen 28 to the low resistance heat sink 30 to cool heated platen 28. Again, as with the first embodiment, binder 22 is held momentarily in the fully compressed position to maintain pressure on sheet 10 and stack 14 as the heated platen 28 cools. The cooling combined with the continuing compression of media sheet 10 and stack 14 allows the reactivated imaging material to cure. Heat sink 30 and the other components are then withdrawn to their starting positions. An electrically dissipative heat sink could also be implemented through a switching circuit selectively connecting heated platen 28 to a heat sink remote from binder 22. The electrically dissipative heat sink could be located, for example, in the printer or even in a server or client computer. A remote electrically dissipative heat could be selectively connected to heated platen 28 through control switching activated by temperature, sheet registration, timing or any other suitable control mechanism.

Figure 5:
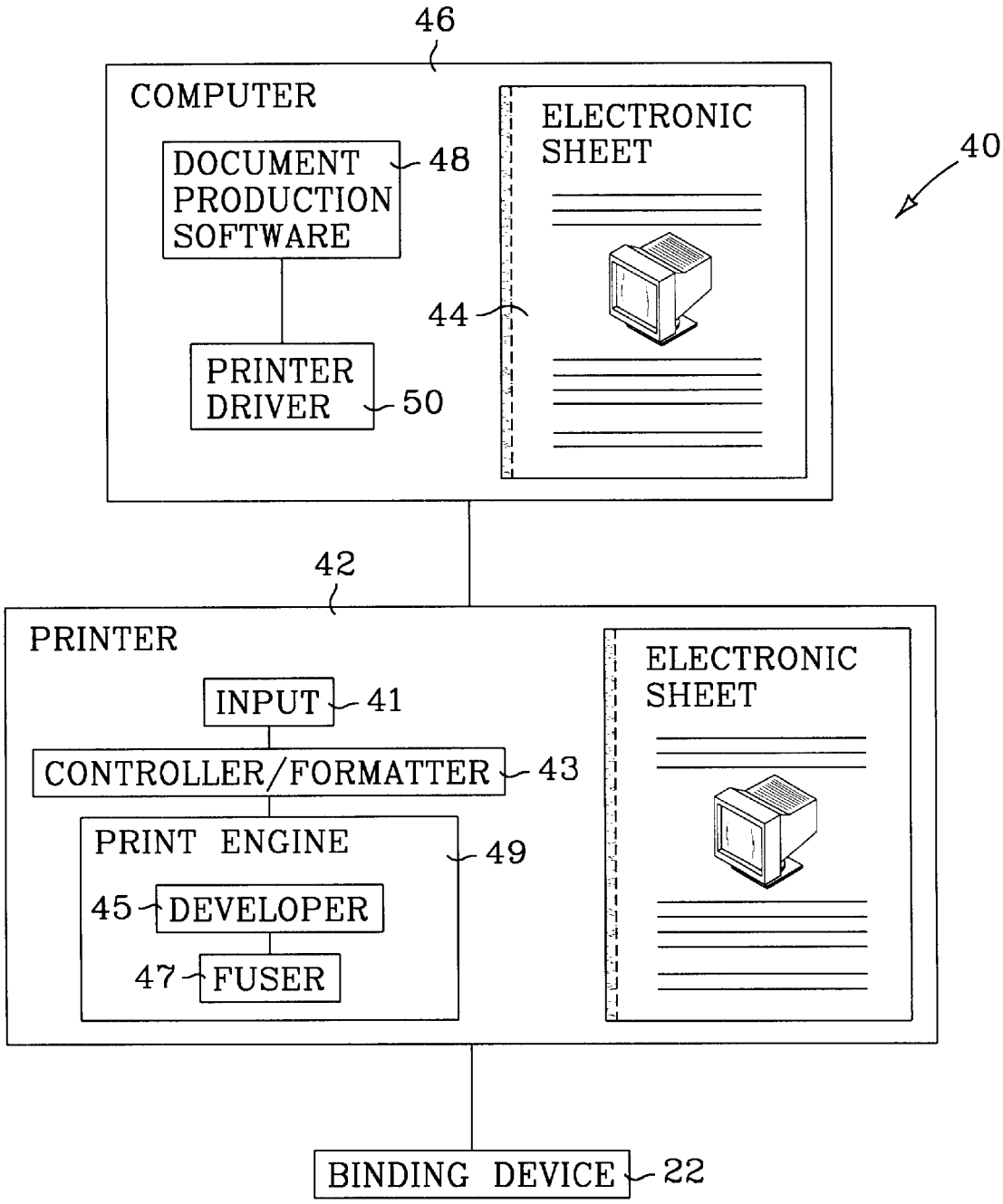
FIG. 5 is a block diagram representing a system for creating, printing and binding a bound document.

Referring now to the block diagram of FIG. 5, it is envisioned that binder 22 will be used as a component of a document production system 40. In addition to binder 22, system 40 includes an image forming device such as printer 42 and one or more computing devices 46. Binder 22 and printer 42 may be separate components or may be integrated into a single appliance. Alternatively, binder 22 may be used as a stand alone device apart from system 40.

Computer 46 may be programmed to generate and/or retrieve a desired print image in electronic form 44 and to transmit electronic document 44 to printer 42 instructing printer 42 to create the desired print image on media sheet 10. This programming may generally be accomplished by document production software 48 in combination with a printer driver 50. However, system 40 does not necessarily require computer 46. Instead, printer 42 may itself perform the functions of computer 46. A digital copier, for example, generates and stores the electronic document itself for subsequent transmission to the print engine where the electronic image is developed into the printed image.

Software 48 electronically creates and/or retrieves desired document 44. Upon receiving a print command, software 48 transmits electronic data representing desired document 44 to printer driver 50. Printer driver 50 compiles the electronic data into a form readable by printer 42, generally breaking the electronic data representing desired document 44 into a plurality of separate print images, each representing a page of desired document 44. Software 48 and/or printer driver 50 may also define binding region 12 for each media sheet 10 to be transmitted along with or as part of each print image. Alternatively, binding region 12 may be defined by printer 42 or by another suitable mechanism. For each media sheet 10 used to form desired document 44, printer 42 applies imaging material in the pattern of the desired print image on one or both sides of media sheet 10. Printer 42 may also apply imaging material to defined binding region 12 located on one or both sides of media sheet 10. Printer 42 activates the imaging material (fuses the toner if laser toner is used) and outputs media sheet 10 to binder 22.

Printer 42 is depicted as a laser printer in FIG. 5. Although it is expected that the binding techniques of the present invention will be most often used with and embodied in electrophotographic printing devices such as the laser printer illustrated in FIG. 5, these techniques could be used with and embodied in various other types of image forming devices. Referring again to FIG. 5, document production software 48 and printer driver 50 transmit data representing the desired print image and binding regions to input 41 on laser printer 42. The data is analyzed in the printer's controller/formatter 43, which typically consists of a microprocessor and related programmable memory and page buffer. Controller/formatter 43 formulates and stores an electronic representation of each page that is to be printed, including the print image and the binding regions. In addition to formatting the data received from input 41, controller/formatter 43 drives and controls the toner development unit 45, fuser 47 and other components of print engine 49.

Figure 6:
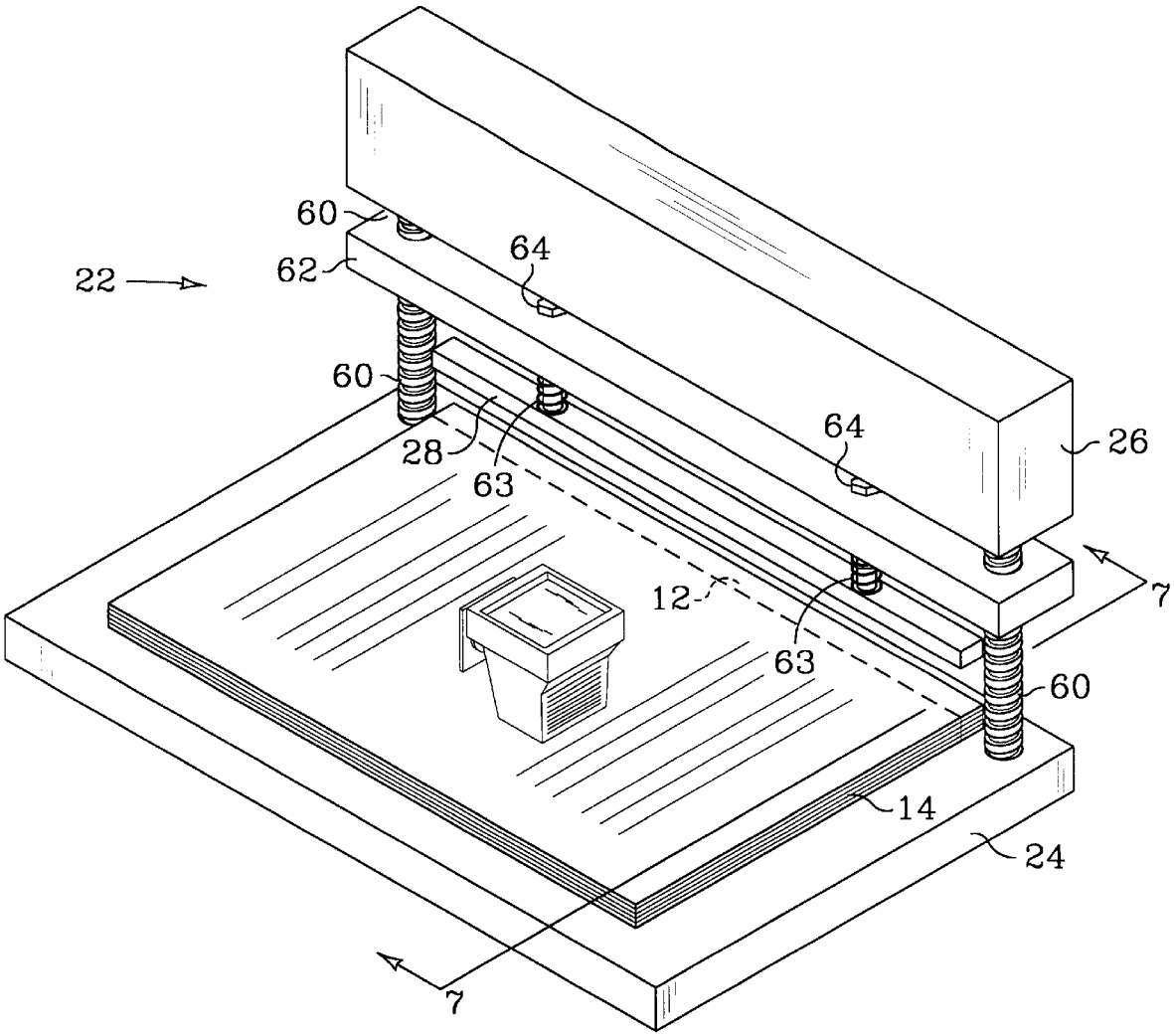
FIG. 6 is a perspective view of a binding device according to another embodiment of the invention in which a lead-screw type press is used.

FIG. 6 illustrates an alternative embodiment of the invention in which press 26 includes lead screws 60 and carriage 62. Carriage 62 supports heated platen 28 and travels up and down or back and forth along lead screws 60. Compression springs 63 are placed between heated platen 28 and carriage 62. Heated platen 28 includes floating guide posts 64 which slide through carriage 62. Carriage 62, in relation to heated platen 28, travels up and down or back and forth along floating guide posts 64 while compression springs 63 bias heated platen 28 away from carriage 62. Press 26 utilizes a servo motor or other suitable mechanism that rotates lead screws 60 driving carriage 62. Depending upon the direction of rotation, lead screws 60 either urges carriage 62 and heated platen 28 toward or away from tray 24. It may is desirable to include a second heated platen 65 (shown FIGS. 7A–7E)coupled to or embedded in tray 24. As lead screws 60 rotate urging carriage 62 in the direction of tray 24, binding regions 12 of sheets 10 are compressed between first heated platen 28 and second heated platen 65. The dual heating elements in this embodiment provide faster heating to reduce binding times, allows the binder to accommodate thicker stacks, and helps prevent damage to sheets 10 by providing a more uniform heat transfer through stack 14.

Figure 7A:
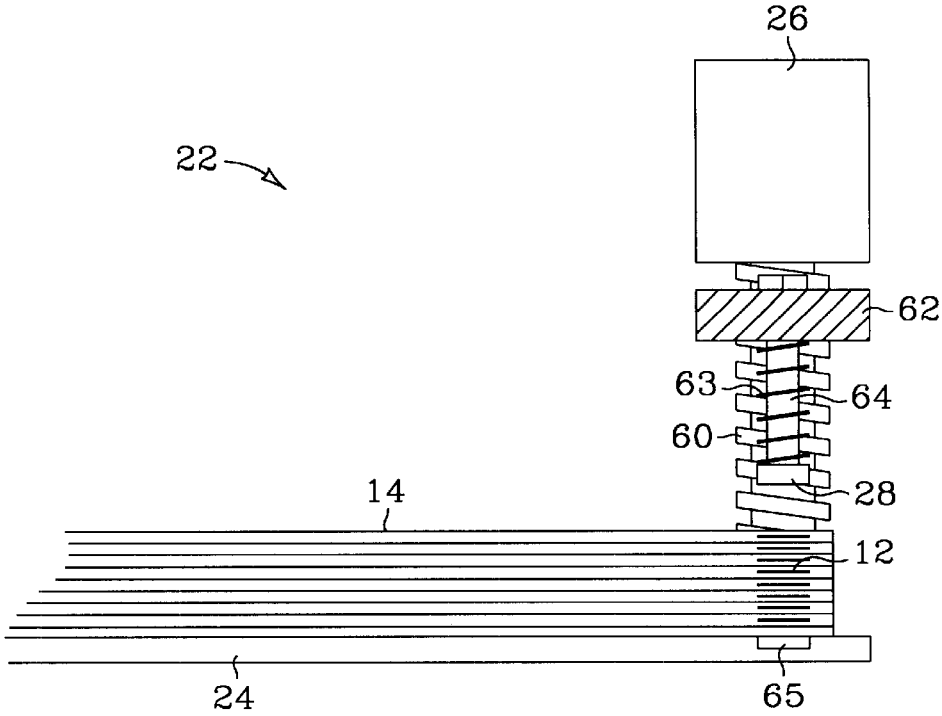
FIGS. 7A–7E are sequential cross sectional views illustrating the operation of the binding device of FIG. 6.
Figure 7B:
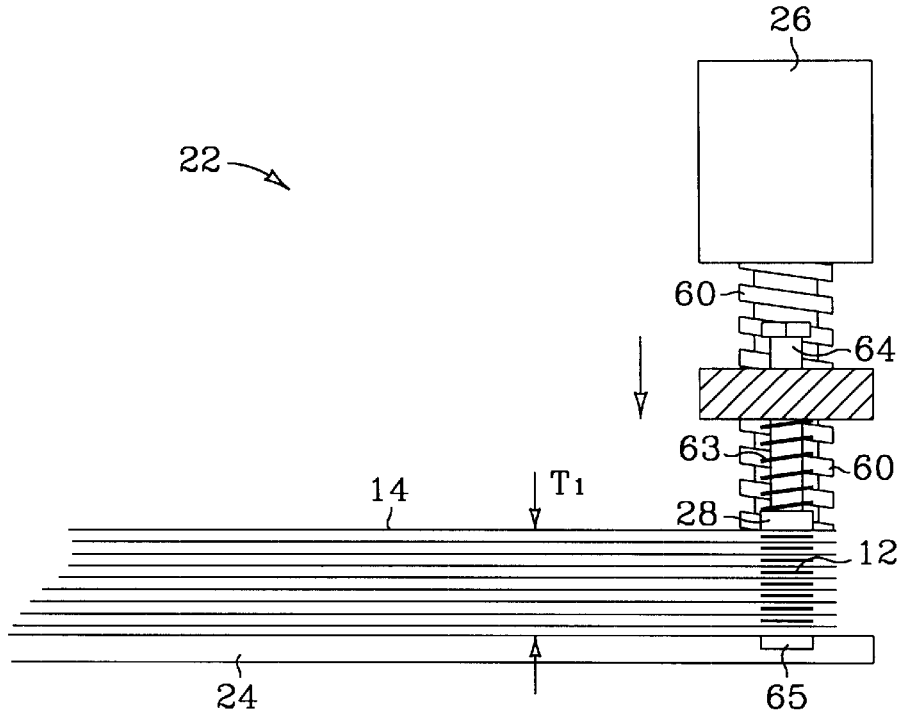
Figure 7C:
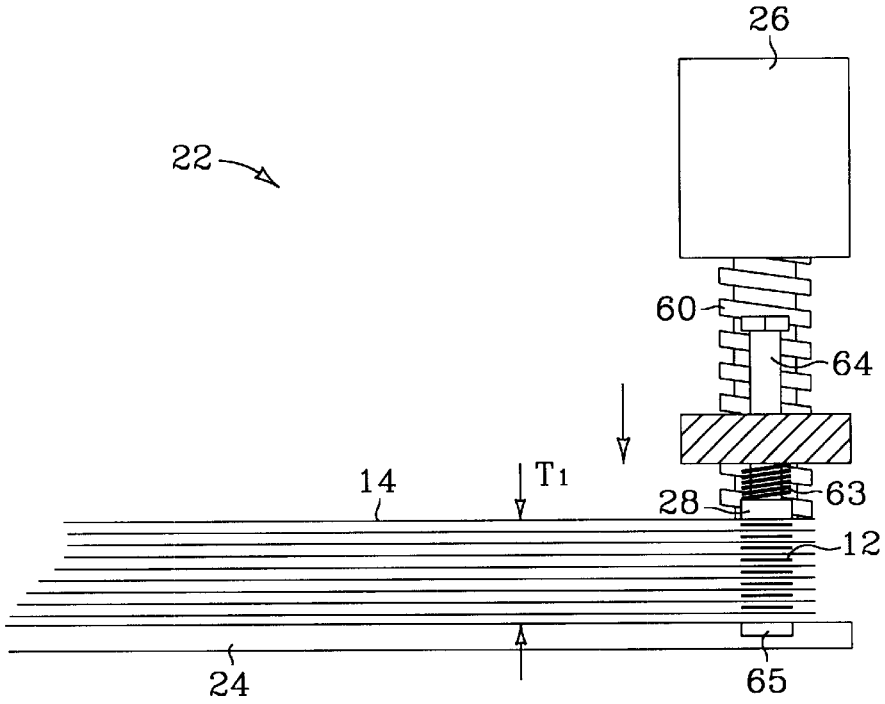
Figure 7D:
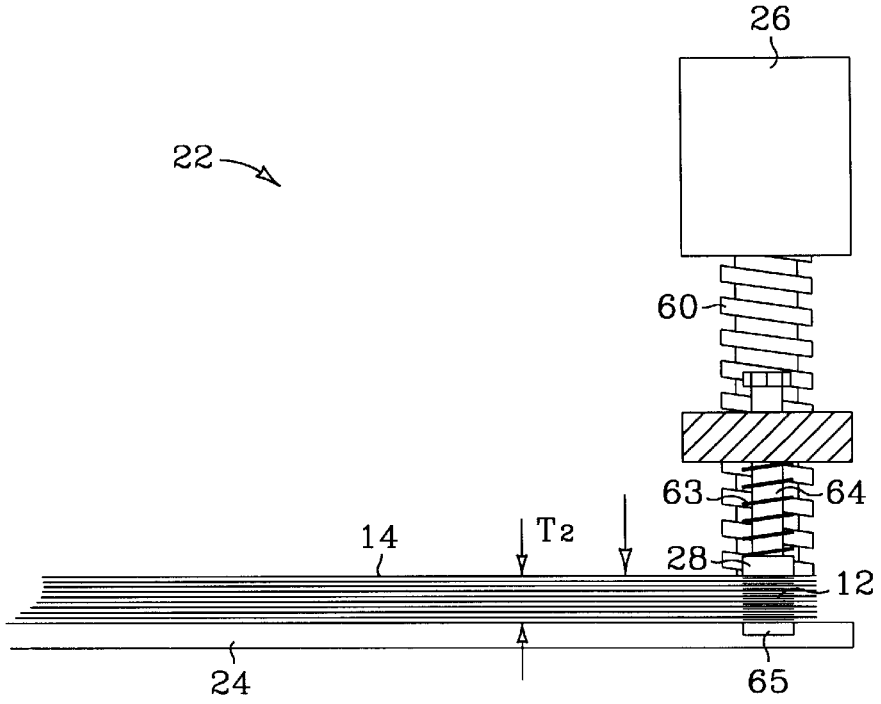
Figure 7E:
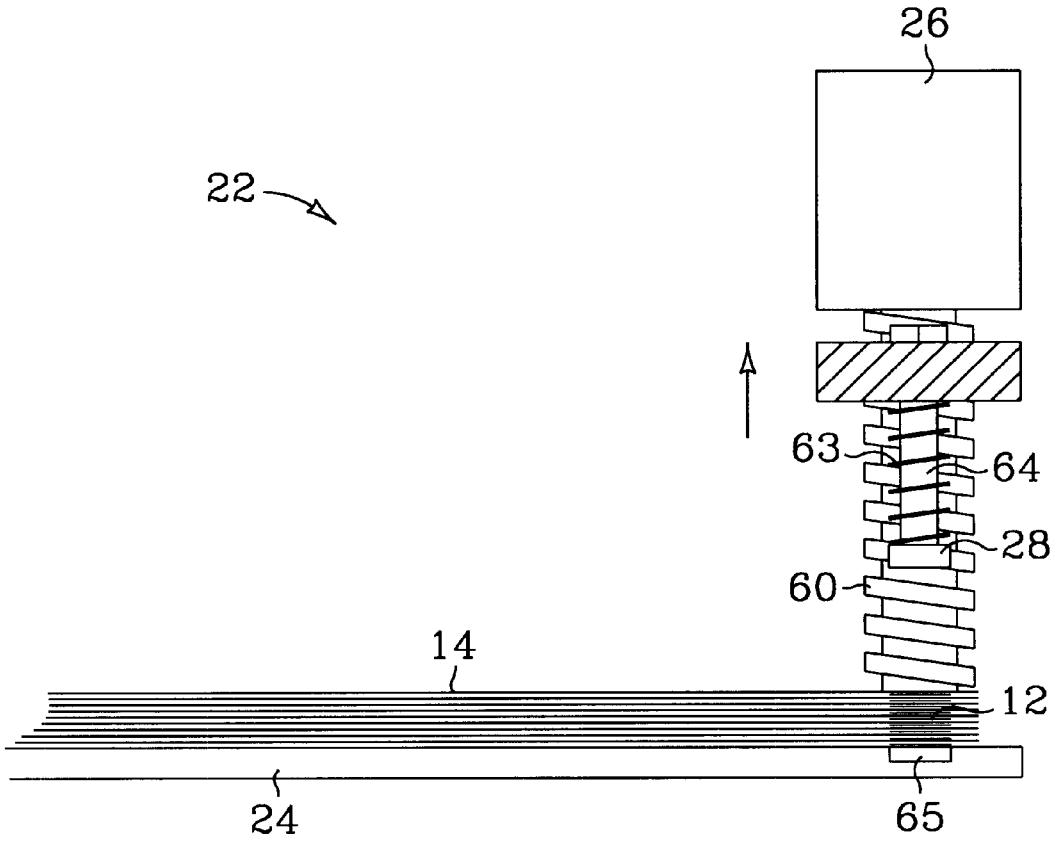

The operation of this embodiment of binder 22 will now be described with reference to FIGS. 7A–7E. With press 26 holding heated platen 28 in the open position as illustrated in FIG. 7A, sheets 10 of stack 14 are initially collected in tray 24 aligning binding regions 12 of sheets 10 between heated platens 28 and 65. In FIG. 7B, lead screws 60 rotate driving carriage 62 and moving heated platen 28 into contact with stack 14 compressing binding regions 12 between heated platens 28 and 65. Continuing to rotate, lead screws 60 cause carriage 62 to overcome the resistance of compression springs 63 and hold heated platen 28 in a first pressed position. The thickness of stack at this point is represented by T1 In FIG. 7C. As heated platens 28 and 65 reactivate the imaging material deposited on binding regions 44, the thickness of stack 14 decreases. Referring now to FIG. 7D, compression springs 63 then expand moving heated platen 28 into a second pressed position causing further compression of stack 14. Consequently, pressure on binding regions 12 is maintained. The thickness of stack 14 at this point is represented by T2 which is smaller than T1. The direction of rotation of lead screws 60 then reverses pulling carriage 62 away from tray 24 separating heated platen 28 from stack 14 while allowing compression springs 63 to fully expand. Stack 14 is bound and can be removed from tray 48.

Once lead screws 60 rotate sufficiently to move heated platen 28 into the first pressed position biasing compression springs 54, press 26 stops, effectively locking carriage 62 in place. Beneficially, the power needed to move heated platen 28 from the first pressed position to the second pressed position is stored mechanically within the biased compression springs 63. Power needed to reactivate the imaging material can then be diverted from press 26 to heated platens 28 and 65.

Compression springs 63 are only one example of a suitable biasing mechanism. Pneumatic cylinders, resilient foam, or other structures or mechanisms that store energy needed to maintain pressure on binding regions 12. Moreover, heated platens 28 and 65 provide only one example of structures capable of activating imaging material. Other structures, or activators, may accomplish the function through direct application of heat as described above, or through ultrasound, magnetic energy, radio frequency energy and other forms of electromagnetic energy. It is possible to use toner which re-activates upon application of pressure alone. The toner used for binding may include magnetic ink or otherwise may have a quality of reacting to electromagnetic, optical or actinic energy (infrared, visible or ultraviolet). The ability to react to energy may be in the form of heat conversion or chemical reaction. The ability to react to energy enhances the ability of re-activating without burning the paper or otherwise damaging the sheets. Hence, pressing a heated platen against the stack is just one structure that may be used to carry out the method of the invention.

Figure 8:
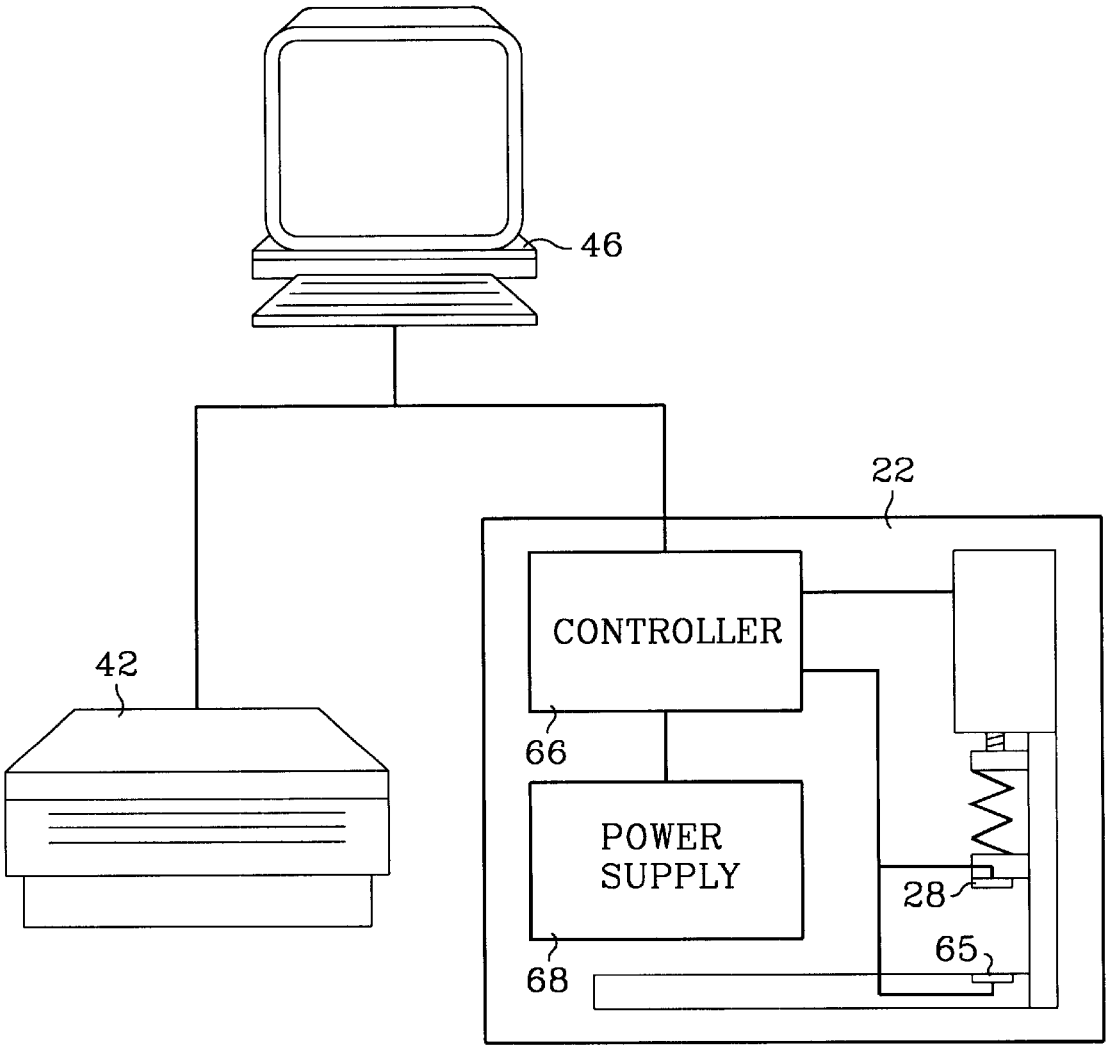
FIG. 8 is a schematic illustration of the binder of FIG. 6 including a controller and a power supply.

In the embodiment illustrated in FIG. 8, binder 22 also includes controller 66 and power supply 68. To help automate binding operations, controller 66 is electronically coupled to computer 46 and/or printer 42 (shown in FIG. 5), press 26, heated platens 28 and 65, and power supply 68. Power supply 68 provides the power needed to operate press 26 and heated platens 28 and 65 and may be a component of binder 22 or printer 42. Once printer 42 dispenses each sheet 10 of stack 14 into tray 24, computer 46 or printer 42 sends a binding instruction to controller 66. Controller 66 contains software or firmware for directing press 26 and heated platens 28 and 65 to bind stack 14. Upon receipt of the binding instruction, controller 66 directs power from power supply 68 to press 26 and instructs press 26 to move heated platen 28 from an open position to the first pressed position compressing stack 14. To re-activate the imaging material, controller 66 then diverts power from press 26 to heated platens 28 and 65. Once the imaging material is sufficiently re-activated, controller 66 removes power from heated platens 28 and 65 allowing the imaging material to fuse to and bind stack 14. Controller 66 then diverts power back to press 26 instructing press 26 to return heated platen 28 to the open position releasing stack 14.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. An apparatus for binding a stack of media sheets having a binding region with imaging material applied thereto, the apparatus comprising:

a tray for supporting the stack:

a movable activator near the tray, the activator having a resistive heating element:

a press coupled to the activator, the press operative between a first position in which the activator is separated from the stack to a second position in which the activator contacts and compresses the stack at the binding region;

a biasing means operatively connected between the press and the activator for biasing the activator against the stack when the press is in the second position; and a controller electronically coupled to the press and the activator, the controller operative to remove power from the resistive heating element as the activator compresses the stack and then divert the power to the press instructing the press to return the activator to the first position.

2. An apparatus for binding a stack of media sheets having a binding region with imaging material applied thereto, the apparatus comprising:

a tray for supporting the stack;

an activator near the tray, the activator having a resistive heating element and the activator movable between an open position in which the activator is separated from the stack, a first pressed position in which the activator contacts and compresses the stack, and a second pressed position in which the activator further compresses the stack;

a press coupled to the activator, the press operative to move the activator from the open position to the first pressed position;

a biasing means between the press and the activator for biasing the activator from the first pressed position to the second pressed positon;

a controller electronically coupled to the press and the activator, the controller operable sequentially to direct the press to move the activator from the open position to the first pressed position, to direct power to the resistive heating element to heat imaging material in the binding region of the stack, remove the power from the resistive heating element as the activator compresses the stack and then divert the power to the press instructing the press to return the activator to the open position.

* * * * *